US007156476B2

(12) United States Patent
Helber

(10) Patent No.: US 7,156,476 B2
(45) Date of Patent: Jan. 2, 2007

(54) APPARATUS FOR IN-WALL STORAGE OF A TOILET PLUNGER

(76) Inventor: Craig Allen Helber, 588 Agana St., Grand Junction, CO (US) 81504

( * ) Notice: Subject to any disclaimer, the term of this patent is extended or adjusted under 35 U.S.C. 154(b) by 178 days.

(21) Appl. No.: 10/102,412

(22) Filed: Mar. 19, 2002

(65) Prior Publication Data

US 2003/0015946 A1 Jan. 23, 2003

Related U.S. Application Data

(60) Provisional application No. 60/277,857, filed on Mar. 21, 2001.

(51) Int. Cl.
*A47B 67/02* (2006.01)

(52) U.S. Cl. ..... 312/242

(58) Field of Classification Search ..... 312/206, 312/207, 242, 245, 257.1, 326, 351
See application file for complete search history.

(56) References Cited

U.S. PATENT DOCUMENTS 1,669,143 A * 5/1928 Pocock ..... 206/362.1
2,965,427 A * 12/1960 Sessions ..... 312/242
D189,567 S * 1/1961 Clayton ..... D6/534
3,095,249 A * 6/1963 Albrecht ..... 312/242
D315,269 S * 3/1991 Brazis ..... D6/551
5,924,566 A * 7/1999 Gibbs ..... 206/361
5,947,208 A * 9/1999 Ha ..... 169/51

FOREIGN PATENT DOCUMENTS

FR 1399139 * 12/1965 ..... 312/206
FR 1535752 * 8/1968 ..... 312/207

* cited by examiner

*Primary Examiner*—James O. Hansen

(57) ABSTRACT

Apparatus for storing and concealing a toilet plunger in a bathroom wall. The storage apparatus comprises restraint means for compressing the toilet plunger cup or bulb and retaining it in a compressed state. In a preferred embodiment, the plunger cup or bulb is compressed to substantially less than its nominal diameter so that the storage apparatus may be substantially contained within the wall.

3 Claims, 2 Drawing Sheets

APPARATUS FOR IN-WALL STORAGE OF A TOILET PLUNGER

REFERENCE TO A RELATED APPLICATION

This application contains subject matter common to provisional Patent Application Ser. No. 60/277,857 filed Mar. 21, 2001 now abandoned by the sole inventor Craig A. Helber of the present Application and for which priority is claimed.

FIELD OF THE INVENTION

This Application relates to an apparatus for bathroom storage, and, more particularly, to an apparatus for storing a toilet plunger.

BACKGROUND OF THE INVENTION

A toilet plunger is a commonplace bathroom accouterment. It is desirable to have the plunger at hand in the case of a problem, yet known storage devices are generally unsightly, unsanitary and take up a significant amount of normally limited bathroom storage space. In addition, unattached storage devices are susceptible to being knocked over.

It has long been known to store bathroom items in a cabinet that is partially or completely recessed into a wall. A typical interior wall comprises 2×4 studs supporting wallboard or panelling on both sides. Thus the dimension available for the recessing of a storage cabinet is equal to the actual width of the stud plus the thickness of the wall material the sum of which is about 3½ to 4 inches in most cases. Since the average diameter of a toilet plunger is about 6 inches, a recessed cabinet would protrude on the order of 3 inches, an amount many would consider unsightly.

In the prior art, the toilet plunger storage invariably sits on the floor. For example, U.S. Pat. No. 5,836,322 shows a combination storage and cleaning device for a toilet plunger. U.S. Pat. Nos. 5,114,006 and 5,305,880 and 5,335,374 teach a storage apparatus wherein the toilet plunger housing is part of the toilet plunger. In all of these references, the storage apparatus is intended to rest directly on the floor.

Thus, a need has existed for an improved storage apparatus for a bathroom toilet plunger.

BRIEF SUMMARY OF THE PRESENT INVENTION

Therefor, it is an object of the present invention to provide a cabinet apparatus for storing a toilet plunger wherein one dimension of the cabinet is less than the diameter of the plunger to be stored.

It is another object of the present invention to provide an apparatus for storing a toilet plunger by means of an in-wall cabinet having door means substantially flush with said wall.

It is yet another object of this invention to provide a toilet plunger storage apparatus which will also store other bathroom items such as cleaning brushes and solvents in a flush-mount in-wall cabinet.

In accordance with a preferred embodiment of this invention, there is taught a toilet plunger storage cabinet having a depth which less than the diameter of the toilet plunger cup.

In accordance with another preferred embodiment of this invention, a toilet plunger storage cabinet having a depth equal to or less than a thickness of a bathroom wall is disclosed.

In accordance with yet another embodiment of this invention, there is provided a toilet plunger storage cabinet having a convenient door which is substantially flush with a bathroom wall.

In accordance with preferred embodiments of this invention, the toilet plunger cabinet includes a restraint member for holding the plunger cup in a compressed state.

In accordance with a preferred embodiment of the present invention, the toilet plunger restraint member is configured to allow emplacement of the plunger without touching the plunger cup.

The foregoing and other objects, features, and advantages will be apparent from the following, more particular, description of the principal embodiments of the invention, as illustrated in the accompanying figures.

DETAILED DESCRIPTION OF THE INVENTION

Figure 1:
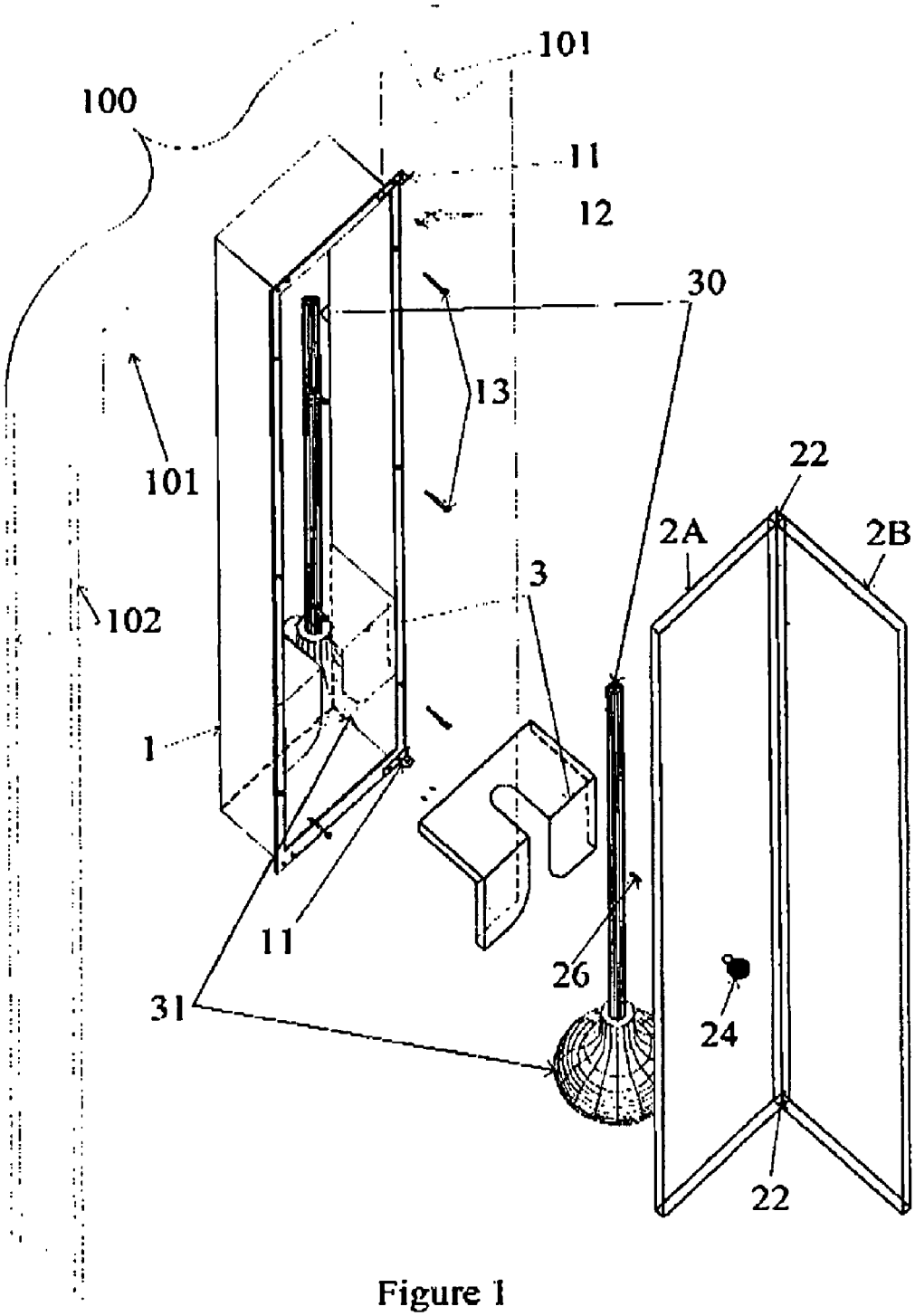
FIG. 1 is an exploded perspective view of the toilet plunger storage apparatus according to the present invention and showing the principal elements thereof, including a recessed storage cabinet, plunger cup restraint means, a plunger retained in the restraint means with cup compressed, and cover means for the cabinet including the restraint and plunger.

Referring now to FIG. 1, there is depicted a storage apparatus according to the present invention for flush mounting in the wall 100 comprising vertical studs 101 and wallboard portions 102. A storage cabinet 1 is mounted in the wall 100 through an opening in the front wallboard 102 by means of fasteners 13 such as screws securing the flange to the wallboard. While the cabinet means 1 could be fashioned from a variety of materials, the mounting flange is desirably thin so as to achieve a nearly flush mounting. In a preferred embodiment, the storage cabinet 1 is formed from 24 gauge galvanized sheet metal. It will be appreciated that in new construction, the storage cabinet 1 could alternatively be secured to the studs 101 in order to achieve a recessed or totally flush installation. A further enhancement of the utility of the cabinet 1 may be achieved by adding a dam across the bottom of its interior near the front to prevent any drippage down the wall.

Since the actual width of the studs 101 is about 3½ inches, a cabinet with the same depth regardless of the thickness of the wallboard 102. However, a typical diameter for a toilet plunger cup 31 is about 6 inches so that the cup 31 must be compressed in order to achieve a storage unit substantially flush with the wall. Such compression could be obtained using a thick door for stiffness. Then very substantial hinges and a strong latching mechanism would be required. As contemplated by the present invention, such compression may more easily be achieved by achieved by restraint means interior of the cabinet 1. An exemplary restraint means according to a preferred embodiment of the present invention is shown in FIG. 1, where the restraint means 3 shown in both the installed position and in an exploded view in order to more clearly show its features. Also shown FIG. 1 is a plunger having a handle 30 and a bulb 31. Restraint means 3 has a substantially horizontal upper surface with a slot or aperture for inserting the handle 30 of the toilet plunger. The slot or aperture extends down the vertical front surface of the restraint means 3 and gradually tapers outward as approaches the lower extremity of the vertical surface. Also shown in the exploded view of the restraint means 3 are flanges at the lateral extremities to provide for mounting in the cabinet 1 in a position sufficiently above its floor so that the plunger cup 31 will fit in the remaining space without effort. To store the toilet plunger, its handle 30 is inserted into the slot in restraint means 3 so that the plunger cup 31 occupies the space between the bottom of the cabinet 1 and the restraint. Then a simple upward pull on the plunger handle 30 brings the cup 31 into its storage position behind the restraint means 3 where the cup is compressed along a diameter. Plunger cup or bulb 31 generically viewed as flexible plunging means. This maneuver is aided by the mechanical advantage provided by the tapered portion of the slot or aperture means in the front face of the restraint means 3. The horizontal top surface of the restraint means 3 may then be used as a storage area for bathroom cleaning agents and utensils.

Cover means in the form of cabinet door is desirably provided to conceal the stored items. An exemplary door is shown in its exploded closed position at 2A and its exploded open position at 2B in FIG. 1. Hinge pins 22 insert into hinge brackets 11 for supporting the cabinet door, and knob 24 together with its retainer 26 facilitate door opening. Since the toilet plunger is totally secured by restraint means 3, the door may be formed from relatively light material such as that used for the cabinet 1. Similarly, the hinge elements and the knob may be relatively minimal. The door may be held closed by a small magnetic latch.

Figure 2:
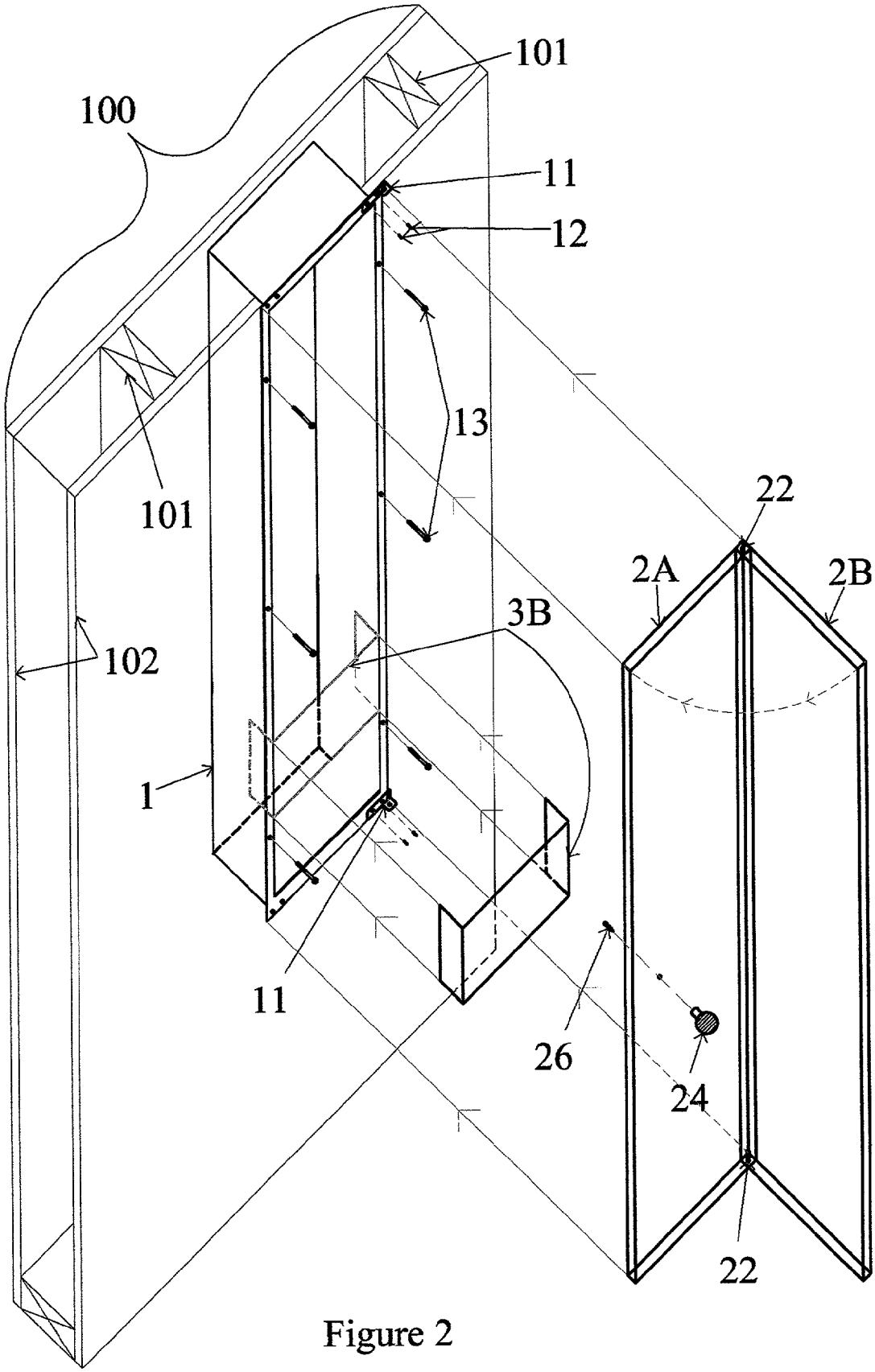
FIG. 2 is another exploded perspective view of the toilet plunger apparatus according to the present invention and showing an alternative embodiment of the plunger cup restraint means.

Referring now to FIG. 2, there is depicted an alternative restraint means 3B in a channel configuration. When mounted into the cabinet 1 such a restraint means 3B allows the plunger to be inserted from the top, which may be advantageous in the case of a bulb type plunger. A frontal slot tapering outwards at she top may facilitate the storage operation. Such an alternative restraint means is somewhat disadvantageous compared with that shown in FIG. 1 because at least some storage space is lost.

While the invention has been particularly shown and described with reference to preferred embodiments thereof, it will be understood by those skilled in the art that the foregoing and other changes in form and details may be made therein without departing from the spirit and scope of the invention. For example, other shapes may be used for the restraint means so long as it is configured to perform the function of keeping the plunger cup or bulb in a compressed position so that its depth is commensurate with thickness of the wall. As an example the restraint means could be configured in the form a box opened at the bottom. Slot or aperture means as shown at 3 in FIG. 1 could be formed in the front and top of the box. The interior of the wall would then comprise the cabinet means for concealing and storing the toilet plunger. Where it is desired not to invade the wall, the storage apparatus according to the present invention may be employed to reduce the plunger storage footprint when mounting directly on the wall surface.

What is claimed is:

1. A storage apparatus for a toilet plunger, comprising, in combination:

A toilet plunger having flexible plunging means, said flexible plunging means having a maximum uncompressed diameter, Cabinet means for defining a storage space for said toilet plunger, Means for restraining and retaining said toilet plunger by compressing said flexible plunging means in a direction along said maximum uncompressed diameter so that said uncompressed diameter is substantially reduced, said means for restraining and retaining said toilet plunger being interior of said cabinet means, Wherein said means for restraining and retaining said toilet plunger has a first major surface and a second major surface substantially perpendicular to said first major surface, said first major surface and said second major surface comprising continuous aperture means for facilitating emplacement of said flexible plunging means.

2. The storage apparatus according to claim 1 further including cover means for said cabinet means and said means for restraining and retaining said toilet plunger.

3. The storage apparatus according to claim 1 where said means for restraining and retaining said toilet plunger compress said flexible plunging means to less than about 4 inches along a direction parallel to said uncompressed diameter.

* * * * *